US005214866A

United States Patent [19]

Hackmack

[11] Patent Number: 5,214,866

[45] Date of Patent: Jun. 1, 1993

[54] CONTINUAL DIGGING, TRANSPORT AND LOADING ACCESSORY FOR EARTH OR MATERIAL MOVING EQUIPMENT

[76] Inventor: Alfred Hackmack, Am Deich 30, Obermarschacht, Fed. Rep. of Germany

[21] Appl. No.: 536,391

[22] Filed: Jun. 11, 1990

[30] Foreign Application Priority Data

| | | | |
|---|---|---|---|
| Jun. 14, 1989 | [DE] | Fed. Rep. of Germany | 3919467 |
| Jun. 14, 1989 | [DE] | Fed. Rep. of Germany | 3919469 |
| Jun. 14, 1989 | [DE] | Fed. Rep. of Germany | 3919470 |
| Dec. 27, 1989 | [DE] | Fed. Rep. of Germany | 3942983 |
| Dec. 27, 1989 | [DE] | Fed. Rep. of Germany | 3942984 |
| Feb. 7, 1990 | [DE] | Fed. Rep. of Germany | 4003641 |
| Feb. 7, 1990 | [DE] | Fed. Rep. of Germany | 4003642 |

[51] Int. Cl.[5] ..... B60P 1/43; E02F 7/00

[52] U.S. Cl. ..... 37/305; 37/359; 37/93; 37/96; 37/190

[58] Field of Search ..... 37/8, 89, 93, 95, 96, 37/99, 100, 101, 107, 190, 192 R, 192 A; 171/16; 414/477, 491, 503, 510, 518

[56] References Cited

U.S. PATENT DOCUMENTS

| | | | |
|---|---|---|---|
| 1,965,000 | 7/1934 | Porter . | |
| 2,384,242 | 9/1945 | Fitch . | |
| 2,696,287 | 12/1954 | Foust | 37/101 X |
| 2,740,211 | 4/1956 | Henry et al. | 37/101 |
| 2,851,143 | 9/1958 | Rosetz | 37/190 |
| 3,096,893 | 7/1963 | Biedess . | |
| 3,241,693 | 3/1966 | Stroker . | |
| 3,512,282 | 5/1970 | Gurries | 37/101 |
| 3,680,233 | 8/1972 | MacDonald . | |
| 4,011,936 | 3/1977 | Hall . | |
| 4,088,236 | 5/1978 | Moore . | |
| 4,183,158 | 1/1930 | Satterwhite . | |
| 4,635,664 | 1/1987 | Theurer et al. | 37/107 X |
| 4,803,789 | 2/1989 | Hackmack . | |

FOREIGN PATENT DOCUMENTS

| | | |
|---|---|---|
| 1007696 | 11/1957 | Fed. Rep. of Germany . |
| 2156776 | 4/1985 | Fed. Rep. of Germany . |
| 3710283 | 10/1988 | Fed. Rep. of Germany . |
| 2049628 | 3/1971 | France . |
| 1451172 | 6/1974 | France . |
| 2236057 | 1/1975 | France . |

*Primary Examiner*—Randolph A. Reese
*Assistant Examiner*—J. Russell McBee
*Attorney, Agent, or Firm*—Thomas L. Adams

[57] ABSTRACT

A continual digging, transporting, and loading accessory can handle material. The accessory is adapted for exchangeable attachment on earth or material moving equipment. The accessory includes a digger outwardly mounted on the earth or material moving equipment for digging the material. Also included is a transporter having an inward unloading end mounted on the earth or material moving equipment and an outward onloading end mounted adjacent to the digger for receiving and transporting the material dug by the digger. The transporter has a carrier for moving between the onloading end and the unloading end to carry the material. The accessory includes a loader having a loading end positioned to receive and transport away from the vehicle the material discharged from the unloading end of the transporter.

36 Claims, 13 Drawing Sheets

CONTINUAL DIGGING, TRANSPORT AND LOADING ACCESSORY FOR EARTH OR MATERIAL MOVING EQUIPMENT

BACKGROUND OF THE INVENTION

This invention relates to earth or material moving equipment and, more particularly, to a continual digging, trans-port, loading accessory for excavators, loaders and dozers.

A general object of my invention is to combine the versatility of the discontinuously working standard excavators, loaders and dozers with the high digging capacity of continuously working earth moving machines; such as bucket-wheel excavators, bucket-loaders (U.S. Pat. No. 554,671) and collecting and conveying equipment for gathering and removing surface material. (U.S. Pat. No. 2,639,022 and U.S. Pat. No. 2,776,036).

There are a number of digging means for excavators and loaders. U.S. Pat. No. 3,230,647 describes a rotary digging head, which can be mounted on a boom and which can discharge onto a carry-off conveyor. An object of that patent is the improvement of the discharge of earth or other material from the loaded pockets of a digging means and not a continual digging and loading accessory for standard excavators and loaders. According to the specification of that patent, it would not be possible to mount that rotary digging head and a conveyor on the standard boom of an excavator like a backhoe. Further there is no loading means and nothing is said about the mounting of a loading means on a slewing upper carriage of an excavator in order to load dump trucks beside the excavator.

SUMMARY OF THE INVENTION

In accordance with preferred embodiments demonstrating principles, features and advantages of the present invention, there is provided a continual digging, transporting, and loading accessory for handling material. This accessory is adapted for exchangeable attachment on earth or material moving equipment. The accessory includes digging means outwardly mounted on the earth or material moving equipment for digging the material. Also included is a transport means having an inward unloading end mounted on the earth or material moving equipment and an outward onloading end mounted adjacent to the digging means for receiving and transporting the material dug by the digging means. The transport means has a carrying means for moving between the onloading end and the unloading end to carry the material. The accessory also includes a loading means having a loading end positioned to receive and transport away from the vehicle, the material discharged from the unloading end of the transport means.

According to another aspect of the same invention there is provided a continual digging, transporting, and loading accessory for handling material. The accessory is adapted for exchangeable attachment on earth or material moving equipment, such as a loader with arms or a dozer with a lifting frame. The accessory includes a transport means and a digging means outwardly positioned for digging the material. The transport means has an inward unloading end and an outward onloading end mounted adjacent to the digging means for receiving and transporting the material dug by the digging means. The transport means is connected to either the digging means, the arms or the lifting frame. The accessory also includes support means mounted on either the dozer or the loader for rotatably supporting the transport means.

One object of the present invention is combining a digging means, a transport means and a loading means into a continual digging-transport-loading unit formed in such a way that it can be mounted and driven by a standard excavator, for example. The fact that an excavator has an undercarriage which stands on the surface and an upper carriage which slews while working demands special support holding devices for the loading means in order to load dump trucks or unload onto heaps.

The loading/unloading means comprises various parts of conveyors and supports mounted on carriers of various kinds. Further, there has to be a solution for the problem that different parts of the boom are moved against each other when working with an excavator. On the other hand, the transport means must be fixed on the upper carriage at a definite position in order to transfer material onto the loading means. The transport means must also have a definite mounting with respect to the boom head. From these facts one can see that the combination of a digging means, a transport means and a loading means has to be specially formed in order to serve as an accessory for standard excavators. The same applies to the invention as an accessory for a loader or a dozer.

Another object of the present invention is to provide a highly desirable digging means for this accessory. One of the main characteristics of such a digging means is the need to keep weight as low as possible. The smaller the difference between the volume of a digging means and the room which can be filled with material, the more advantageous is such a digging means, because it means low dead weight of the digging means and high digging capacity. In order to achieve this advantage, I developed the various digging means described in this patent.

As an example, compare the above mentioned rotary digging head of U.S. Pat. No. 3,230,647 to the digging wheel described in FIG. 4 of this specification. The ratio of the volume of the digging head of U.S. Pat. No. 3,230,647 to the volume that can be filled with material is about 10 to 3. The corresponding ratio of the present digging wheel described in FIG. 4 is about 10 to 9. Thus the present digging wheel has about three times as much digging capacity using the same revolutions/minute. From a dimensional and weight point of view, in order to get the same output with the digging head of the U.S. Pat. No. 3,230,647 as with the present digging wheel, it would be necessary to use excavators which have three times the tipping load and lifting capacity. Thus a given output requires excavators and loaders three times the size of that needed for the presently disclosed digging wheel. Thus the present digging wheel can be mounted on much small excavators and loaders and still get a much higher output than is possible with a conventional bucket. This advantage is not possible with the rotary digging head of U.S. Pat. No. 3,230,647.

Each of the digging means described in this patent application has its special applications and advantages: The digging wheel of FIG. 4 has the advantage if working on high banks and in sticky soil. The lateral rotary digging head of FIG. 5 which works by slewing an upper carriage of an earth mover has its advantages on low banks and sticky soil. The bucket (FIG. 1) has advantages if large stones are to be moved. These stones can be lifted and set aside by the bucket. The conveyor belt with blades and a support pressure means (FIG. 7) is a simple economical and light digging means. The combination of a digging wheel and auger (FIG. 11) or side conveyor belt with cutting blade is applicable if the accessory is mounted on a loader or dozer. This digging means has the advantage of mounting directly in front of the front wheels of small light-weight loaders, because the material can be lifted by the present digging wheel (FIG. 12).

Another object of this invention is to provide a more effective transport means for the transport and loading function of the accessory.

Another object of this invention is to provide a more effective loading means.

A further object of this invention is to enable contractors to use the standard earth moving equipment such as excavators, dozers, loaders, for a much more effective digging-unloading system than that of the excavator-dump truck system currently in use. The term earth moving equipment includes equipment for moving material such as agricultural or mining products, and various other types of material Also the term includes equipment that is self propelled, externally propelled, moveable slightly or stationary.

A general advantage of the present continual digging and loading accessory mounted on an excavator or a loader is an increase in the digging output by about three or four times in comparison to bucket operation. For example, a 20 ton excavator has an output of about 130 to 150 cubic meters/hour with a bucket. With the present accessory, this output can be increased to about 600 cubic meters/hour. If there is put an additional hydraulic power unit of about 300 horsepower onto the excavator, the output will be increased 10 times to about 1,500 cubic meters/h. Furthermore, a 3 ton, skid steer loader with a hydraulic unit rated at 50 horsepower, loads about 30 to 40 cubic meters/hour with a bucket, but loads about 150 to 160 cubic meters/hour with an accessory according to the principles of the present invention.

In all stockyards where loose material such as gravel or coal is stored, this material has not only to be loaded onto lorries, it also has to be piled as high as possible in order to save stock space. Therefore a further object of the invention, is that the continual digging and loading accessory can be simply changed into a stacker and piling equipment.

BRIEF DESCRIPTION OF THE DRAWINGS

These and other objects of this invention will become apparent from the following detailed description when taken together with the accompanying drawings, wherein.

DETAILED DESCRIPTION OF THE PREFERRED EMBODIMENTS

Figure 1:
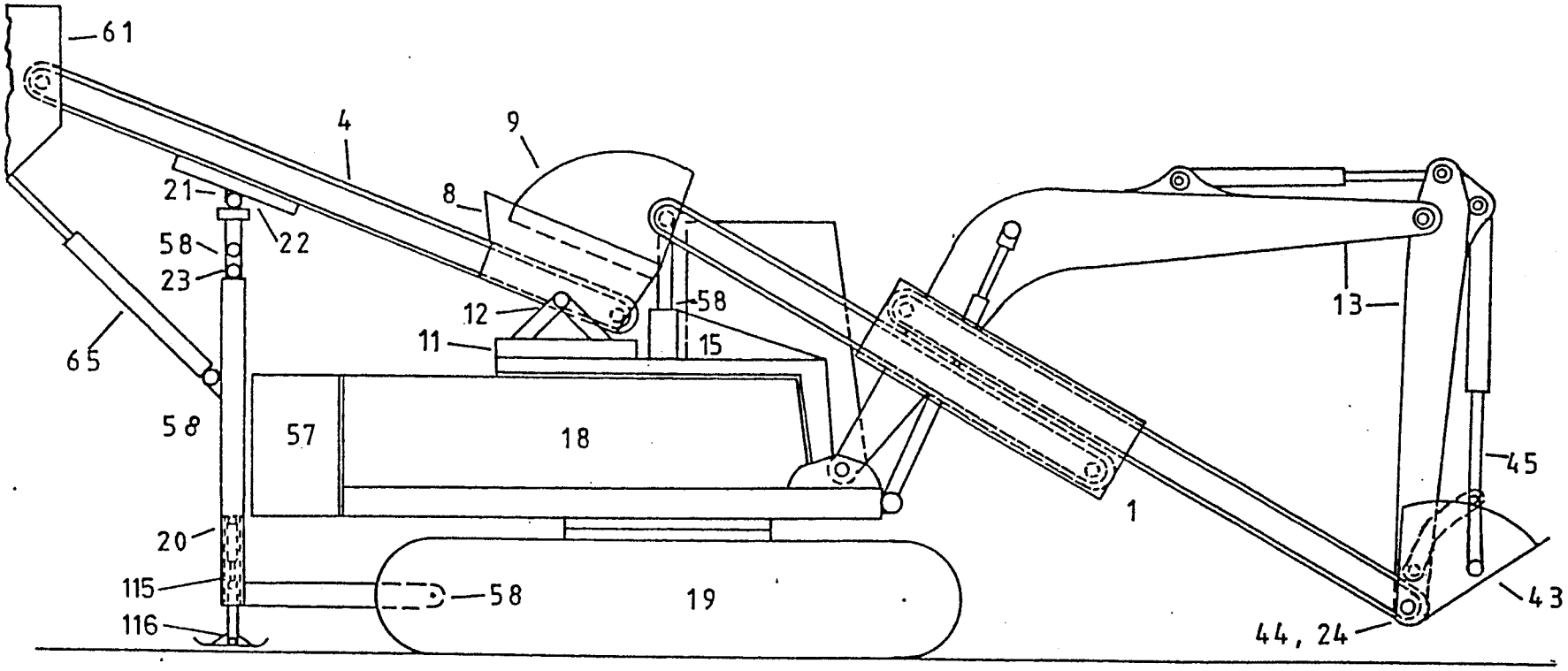
FIG. 1 is a side view of an accessory with a bucket as digging means, mounted on a standard excavator with a backhoe boom, according to the principles of the present invention.

FIG. 1 is a side view of an accessory mounted on an excavator with a backhoe boom 13 using a bucket 43 as digging means. Bucket 43 is mounted to the side of boom 13 in front of conveyor 1 (see for example, the embodiment of FIG. 10, hereinafter). Bucket 43 and conveyor 1 are mounted with the bolt 24 in the bushing on the head of the boom 13 on which originally the backhoe bucket was mounted. This mounting is done in such a way that the articulating point of bucket 43, the axis of the onloading drum of conveyor 1, and the axis of the bolt 24 are coaxial to axis 44. This has the advantage that the bucket 43 will rotate around the axis of the drum. This ensures that material taken up by bucket 43 is shifted onto the conveyor belt in any position which the bucket may take. The hydraulic cylinder 45 of the backhoe boom is connected with the bucket 43 to articulate it.

The conveyor 1 operates as a transport means and is telescopic in order to adjust to all movements of the segments of boom 13. Conveyor 1 has a pair of conveyor belt systems, the lower one fixed in a sleeve, the upper one slidingly held on either side by unillustrated rollers in the sleeve. Conveyor 1, equipped with a chute 9, is mounted on the upper carriage 18 of the excavator by vertical posts having a bushing-bolt connection 58, the vertical post being inserted into sockets on frame 15. Chute 9 is fixed on conveyor 1 with its lower part forming a circle. On frame 15 are also mounted the two rotating devices: horizontal plate 11 mounted on frame 15 for azimuthal rotation; and vertical gimbal 12 adapted to accommodate angular changes in elevation. Loading conveyor 4 is equipped with chute 8. Since conveyors 1 and 4 are not aligned, chute 9 can deflect material from conveyor 1 into chute 8, a three-sided funnel mounted on conveyor 4.

Loading means 4 is supported on a further point by a support 20. Support 20 is attached to the undercarriage 19 of the excavator and is equipped with a skid 116, which can be moved by hydraulic cylinder, 115. Cylinder 115 can balance the excavator if the weight of loading means 4 is too heavy to prevent tipping. Atop support 20 is a means 23 for changing the height of the support in the form of a bolt fitting into one of a number of height setting holes in a sliding core and by that changing the height of the unloading end of the loading means.

Rotating means 22 includes preferably a roller 21 on which the loading device can roll lengthwise. Such translation occurs if the vertical axis of the rotating device 11 is not coaxial with the vertical axis of rotation between the upper carriage 18 and the undercarriage 19 of the excavator (they are not coaxial in this illustration). With such non-alignment, lengthwise and sidewise conveyor translation occurs when the upper carriage 18 is slewing around the under carriage 19. By this holding means 22, the upper carriage 18 of the excavator can slew and dig on the bank while the loading conveyor 4 is held in about an azimuthally fixed position to load dump trucks.

In another embodiment, the horizontal arm (rod) of the support 20 can-be mounted rotatably on the rotating means 11 of the accessory or on a specially made rotating means mounted around the rotating means of the excavator. A wheel may be mounted on the bottom of the support 20 which is driven and steered hydraulically. The advantage of this latter embodiment is to have a support for a longer loading conveyor and the possibility of moving the conveyor to the rear for transport.

In another embodiment, the loading conveyor 4 can during the slewing action of the upper carriage 18 be held in a firm position for loading dump trucks by an hydraulic motor driving the rotating means 11 and controlled by an hydraulic valve, which is advantageously programed electronically.

The chute 61 can be moved around a pivot point by a cylinder 65 to load two dump trucks standing side by side, without interruption. The excavator is equipped with a hydraulic power unit 57. The accessory is connected with the excavator with easy to connect and dismount bushing bolt connections 24, 58.

The accessory can be equipped with the combination of digging wheel 25 and auger 85 (for example, FIG. 12 but with only one auger and one digging wheel); in this case it can also be used as stacker. In such instance, a hopper is mounted in front of the digging means with a width of about 2.50 to 3.00 meters, in which dump trucks can dump their loads. For instance, gravel can be taken up by the digging means, transported up to the upper carriage 18 and piled up by the loading means 4.

Figure 2:
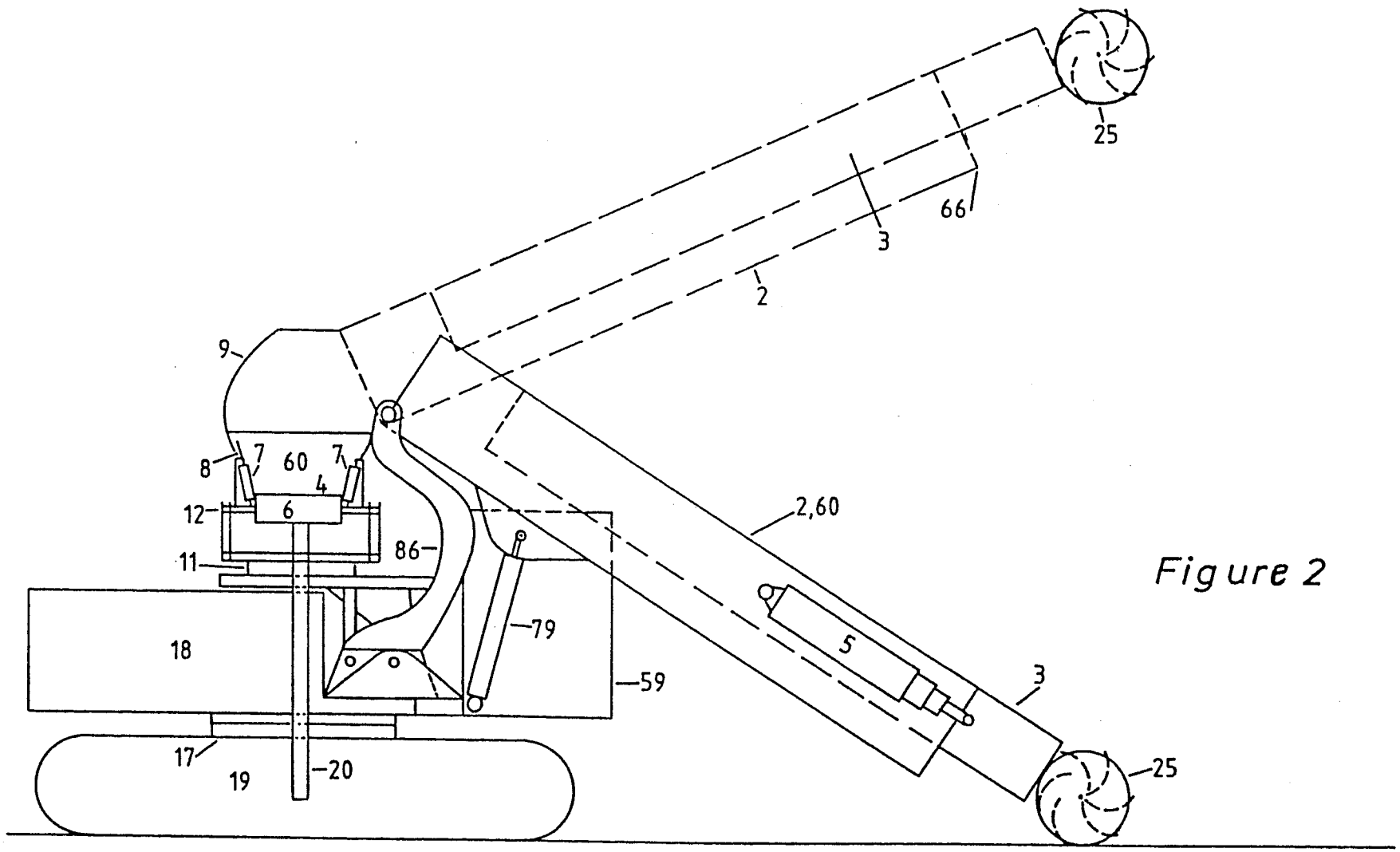
FIG. 2 is a side view of an accessory mounted on an excavator with a transport means formed as a boom and a digging means formed as a digging wheel, which is an alternate to that of FIG. 1.

FIG. 2 is a side view of the accessory modified with a telescopic conveyor as transport means shown as boom 2, 3 with a digging wheel 25 in front. The telescopically moving part of boom 3 is moved by cylinder 5. With the telescopic boom, an inclination can be dug into a steep bank in a way that earth high on the bank is not under-mined to fall on the boom, damaging it.

The boom 2, 3 uses a box-type conveyor 66 much like the conveyor on loading means 60. This box-type convey-or has a bottom belt 6 and, on each side, belt 7 with a rather steep inclination. This three-belt, box-type conveyor is closed on the bottom and on the sides and open above and on the head ends. The closing connection between the bottom belt 6 and the two side belts 7 can be achieved by pressing the upper part of the bottom belt 6 into the wedge by the two inclined vertical belts 7; or by V-belts vulcanized on the belt edges in order to carry the sides of the bottom belt; or by means like zippers, hook and eye connection, or similar means which are connected when the vertical and horizontal belts run together at the one head end and they are disconnected when at the other head end the two belts part. The advantage of the three belt box conveyor is that the capacity of the conveyor is advantageously related to the height and width of the conveyor. The width of this three-belt, box-type conveyor in comparison to a normal conveyor with the same capacity is about one third.

The conveyor-boom 2, 66 is pivotally supported at its downstream end by the supporting frame 86 (part of the accessory) mounted on the upper carriage of the excavator and can be moved by the boom cylinder 79 of the excavator. Conveyor-boom 2, 66 communicates with a chute 9, an inverted, cup-shaped hood with sliding skirts enclosing the sides of conveyor 3.

The loading means 60 is supported on the rotating devices 11, 12 and by the support 20. Support 20 supports the outer end of loading means 60 and is constructed much like support 20 of FIG. 1. Support 20 is again attached to undercarriage 19. The vertical axis of rotating means 11 is coaxial with the vertical rotation axis of the excavator between undercarriage 19 and upper carriage 18. The cabin of the excavator has been moved forward and sidewards in order to achieve this.

Figure 3:
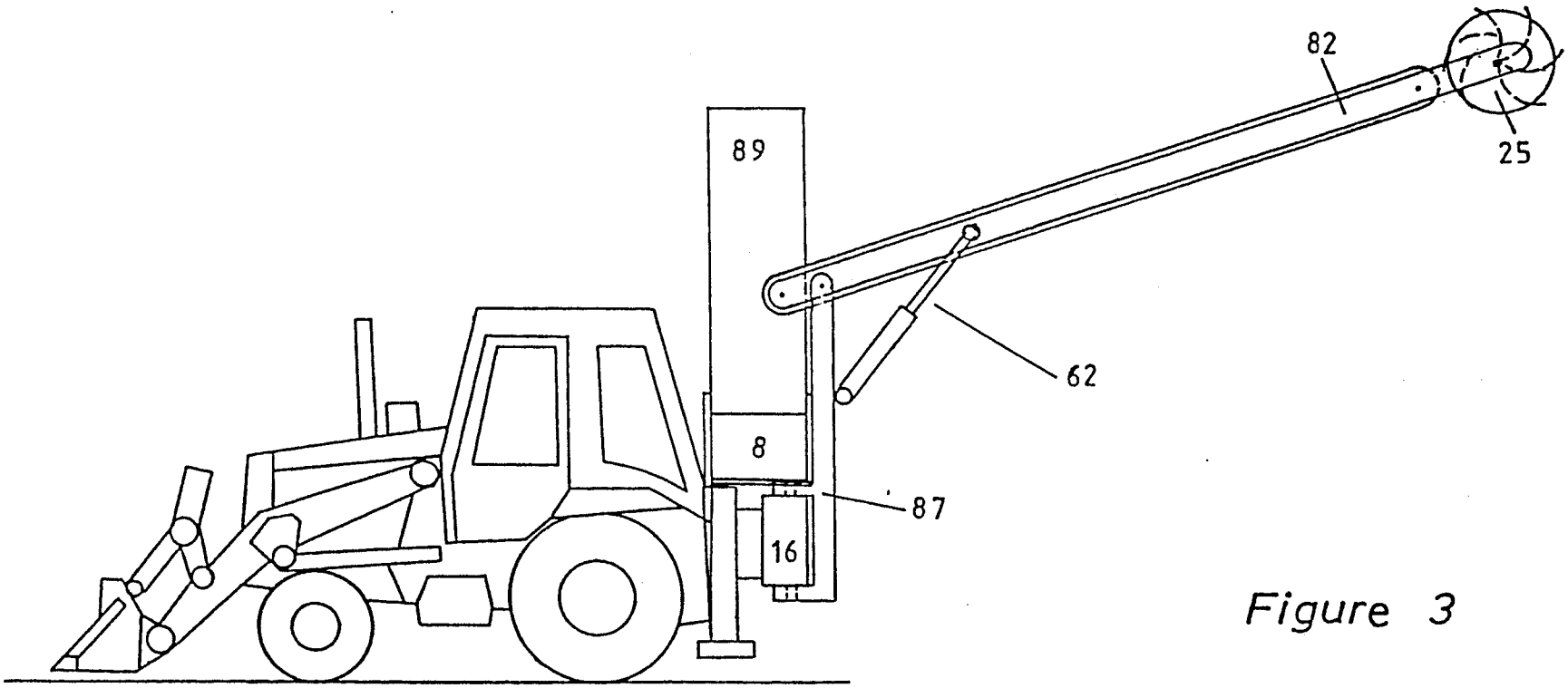
FIG. 3 is a side view of an accessory mounted on a backhoe loader, which is an alternate to that of FIG. 1.

FIG. 3 is a side view of the accessory, adapted for mounting on a backhoe loader. The supporting frame 87 for the conveyor/boom combination 82 is mounted on the rotating device 16 on which originally the boom was mounted. Frame 87 is an upright having an upper pivot connected to the frame of conveyor 82. The pivotally mounted conveyor-boom combination is lifted and lowered by hydraulic cylinder 62. The digging and transport means 82, 25 can also be mounted on the backhoe boom as shown in FIG. 1.

A loading means 89 (substantially the same as loading means 4 of FIG. 1) is mounted on the backhoe frame and can extend transversely to either side of the backhoe loader. Alternatively, the loading means 89 can be mounted on the supporting frame 87 to extend forwardly over and above the loader. Loading means 89 is equipped with a chute 8 similar to that of FIG. 1.

Figure 4:
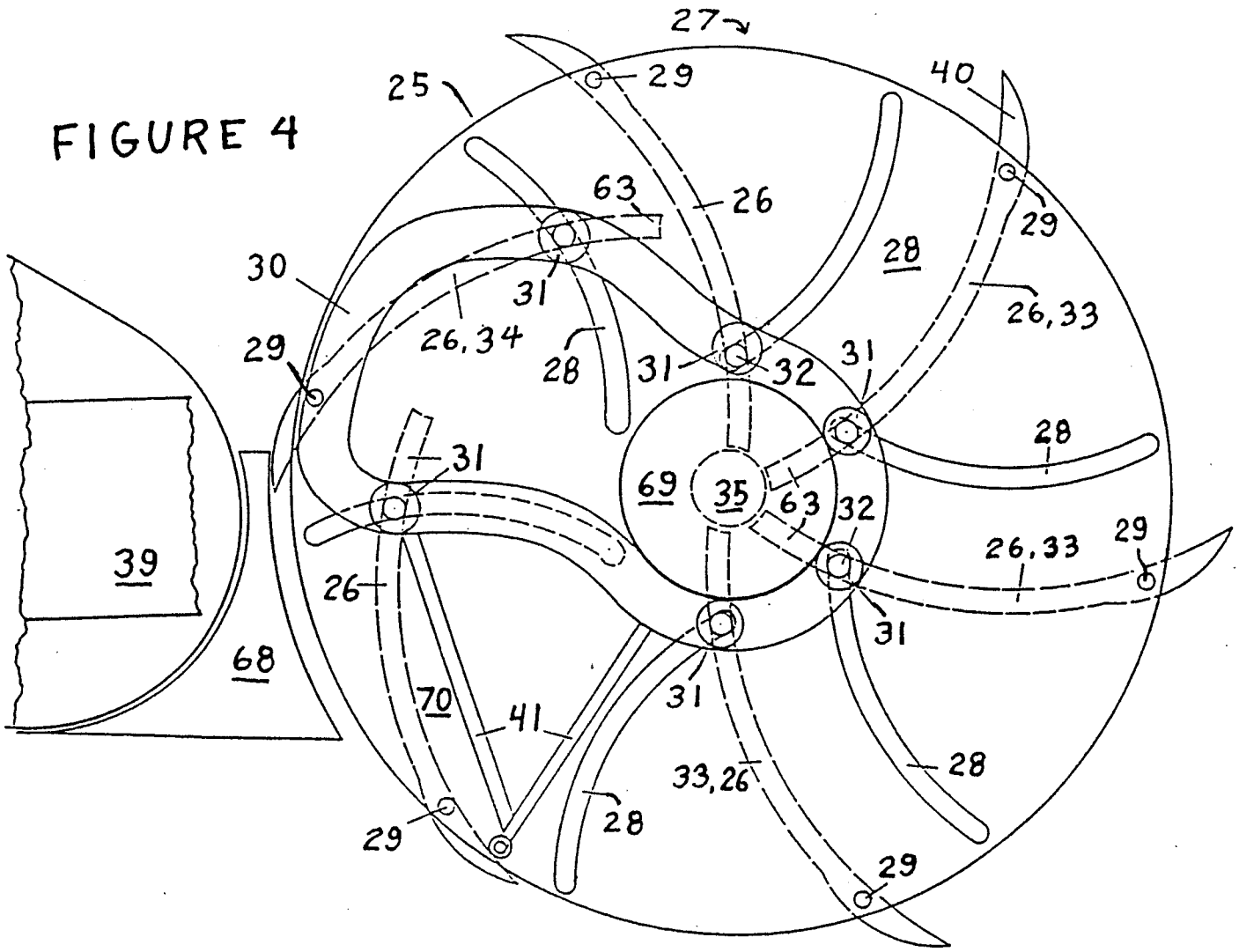
FIG. 4 is a side view of a digging means of the accessory, employing a digging wheel with tiltable blades.

FIG. 4 is the side view of a digging wheel 25 with tiltable blades 26, 34, 33 mounted on pivots 29 between a pair of side plates, holders 27. Holders 27 are fixed on shaft 35, which 35 is journalled on frame 39 of the accessory. Bolts 32 are connected to the inner edge of blades 26 and support rollers 31, which run in guide rail 30, mounted on frame 39. The guide rail has such a shape that the blades 26, 34, 33 will be moved by the rollers 31 and bolts 32 into the radial digging position 26, 33 when digging, and circumferentially outward into an emptying position 26, 34 if the wheel rotates by the hydraulic motor (not shown).

The blades 26 are sized, curved and suspended in such a way that during the tilting movement, the inside edge 63 of the blade (which is positioned in front of a following blade) will pass along the front curve of this following blade, cleaning it and emptying its pocket. While blade 26 is in the outside position, its rear side passes alongside and is cleaned by scraper 68. During the tilting movement, slots 28 in the sideholders 27 in which the bolts 32 slide. The bolts 32 connect to rollers 31 and blade 26. The emptied soil is transported onto a conveyor belt. Optionally, there can be used a blade redrawer 41 which usually is not necessary. Redrawer 41 is firmly fixed on the outer rails. The outer part of the shovel hits it and turns it around pivot point 29, bringing the roller to the inner circle of the rails. Furthermore, instead of guide rail 30 and rollers 31, other blade guides can be used; for example, controlled hydraulic cylinders.

Figure 5:
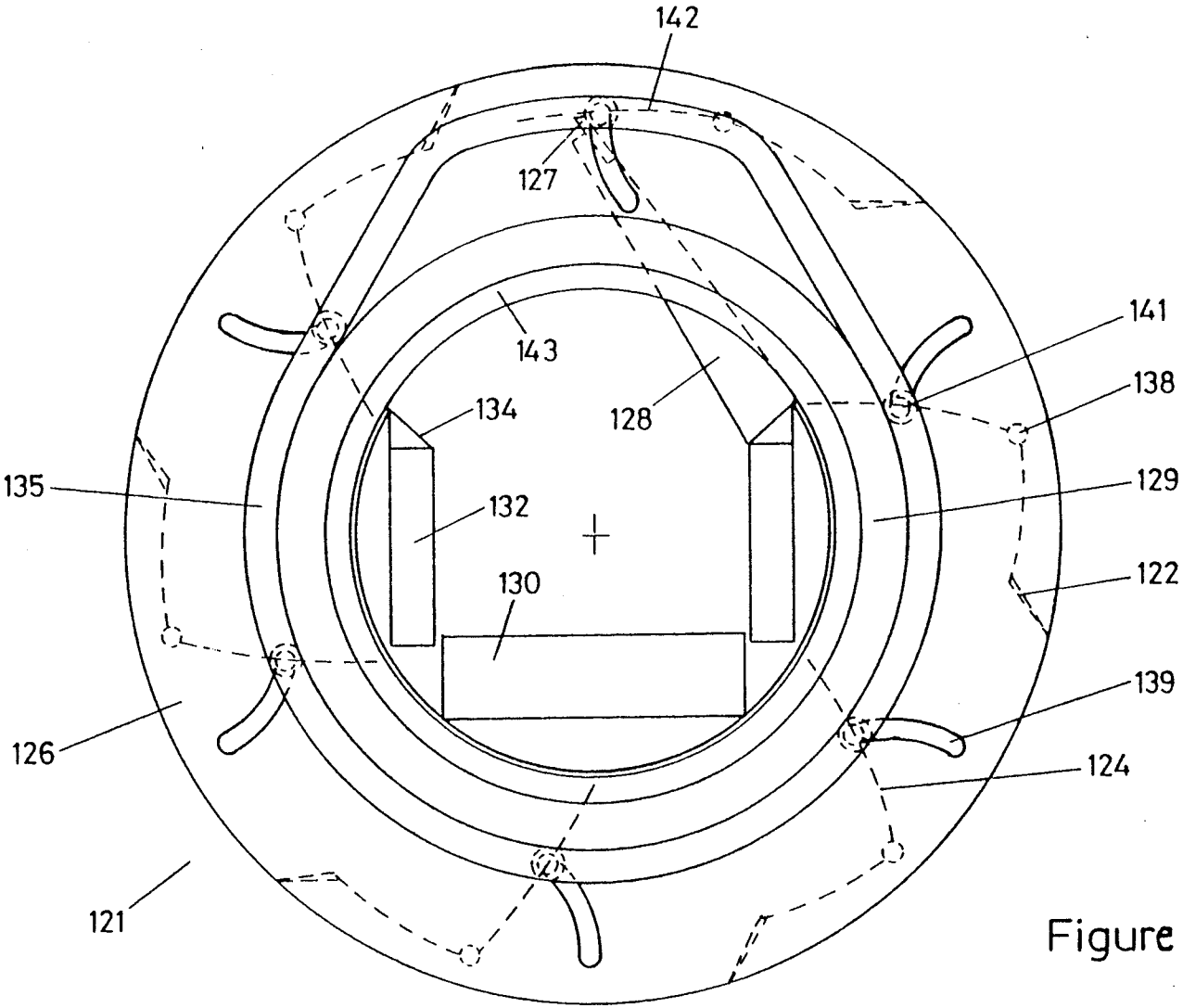
FIG. 5 is a rear view of a lateral digging head, which is an alternate to that of FIG. 4.
Figure 6:
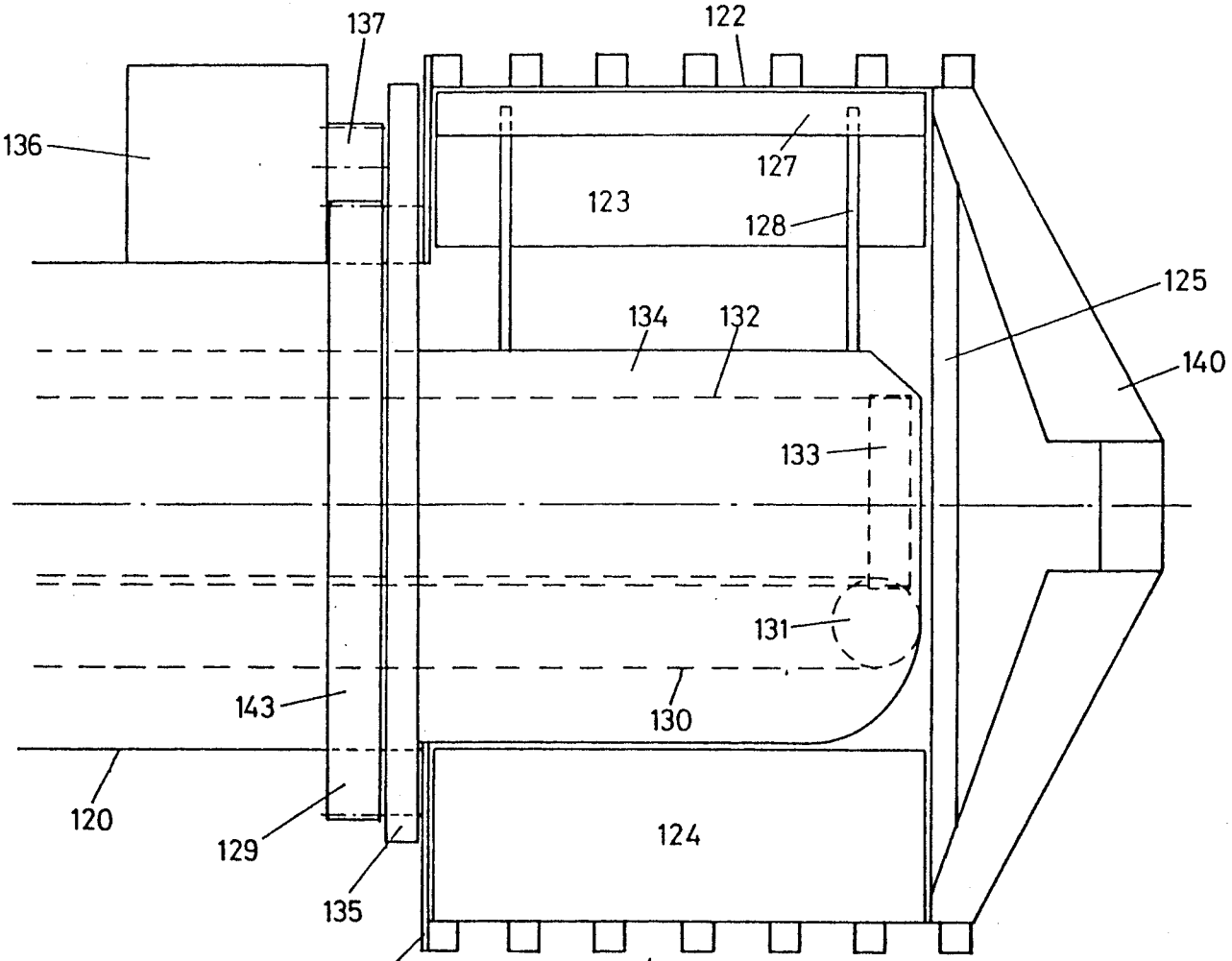
FIG. 6 is a side view of the lateral digging head of FIG. 5.

Referring to FIGS. 5 and 6, they show a lateral (axis transverse to those of previously illustrated digging means) rotating digging head 121. Digging means 121 for the accessory has the non-rotating part of rotating means 143 fixed to the boom 120 which supports conveyor belt 130, 132, 134. Brackets (not shown) on the outside of non-rotating bearing 143 support guide rail 135.

Blades 127 are supported in a circumferential position between ring 125 and plate 126, with outwardly inclined teeth 122 on their leading edge. Pivotally mounted at the trailing edge of blades 122, 127 are the moveable part of the blades 124, 123. Rollers 141 run in guide rail 135 and connect with the moveable part of the blades 124, 123. The guide rail 135 is shaped in such a way that the moveable parts of the blades 123, 124 are lifted (position 142) over scraper 127 held by a support 128 in order to be cleaned. Behind the scraper, the moveable part of the blade 123, 124 is guided back to a sheet metal course 134 which is situated around the conveyor belts.

The connection bolt between roller 141 and blade 123, 124 is sliding through slots 139 in the support 126 (attached to the moveable part of the rotating device 129). The guidance of the blades 123, 124 can be achieved by other means such as springs, hydraulic cylinders, a chain running around sprockets (one or two) in an eccentric position, and one in a centric position (one or two).

The digging head also has front cutters 140 (FIG. 6). The non-tilting part of the blade 127 has teeth 122. Tiltable part 124, 123, 142 can be tilted around the pivot point 138. In the middle of the digging head 121 is a three-belt, box-type conveyor belt with a horizontal belt 130 with a drum 131 and two vertical conveyor belts 132 on each side with drums 133. This three-belt, box-type conveyor belt is covered by sheet metal cover 134. The firm blade parts 127 are mounted in the rear on ring support 126 and in front on ring 125.

The ring support 126 is connected to the movable part of the rotating device 129. The firm part of the rotating device 143 is connected with the pipe type boom 120 comprehending the conveyor. The hydraulic motor 136 drives by the sprocket 137 the movable part of the rotating device 129.

Figure 8:
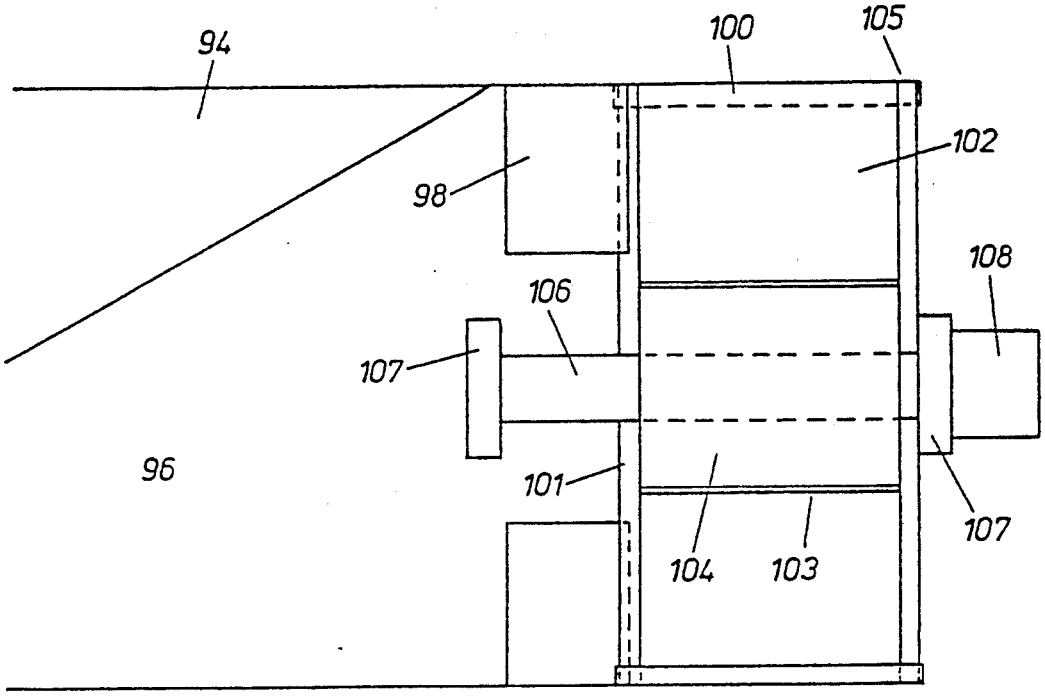
FIG. 8 is a top plan view of the digging means of FIG. 7 combined with an auger and a bucket.
Figure 7:
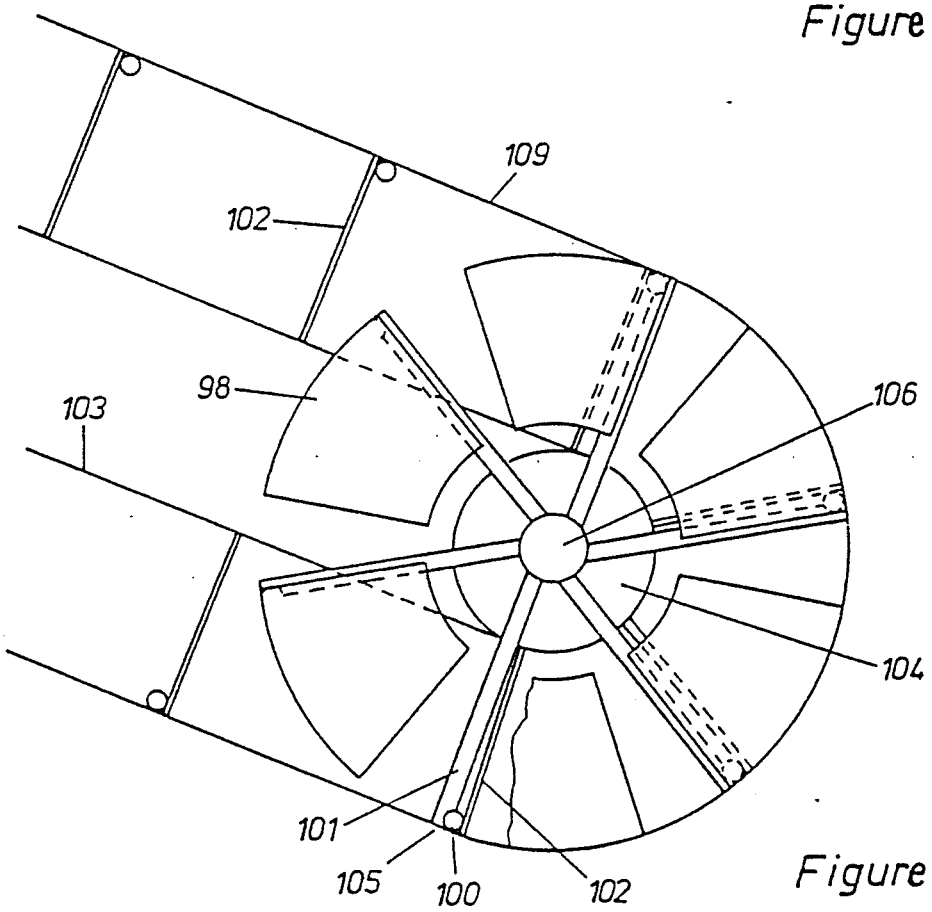
FIG. 7 is a side view of a digging means for an accessory employing a combined conveyor belt with blades and a support pressure device for these blades.

Referring to FIGS. 7 and 8, conveyor belt 103 with blades 102 on the outside connected with steel strings 109 travels on drum 104. On the inner end of shaft 106 are mounted radial spokes 101 with notches on the outside end sized to engage the ends of bolt 100. Bolt 100 is at the tip of blades 102 on the trailing side. Spoke 101 supports and presses blade 102 by the rotating action of spoke 101 and by that forces the cutter of the blade even through hard soil.

This design allows material to be brought between the blades from the side by an auger device 98 (or a conveyor belt with a cutter blade) from a bucket 96 fitted on the side of this device. Component 94 is a support for bucket 96, which is conical. On the side of the spokes 101 are paddle augers 98. These paddles can be mounted as well directly on the shaft 106.

On the opposite side of this device, the support pressure device is a disc fixed on the drum 104 with circumferential notches in which the ends of the bolts 100 are taken up and then pressed by the disc around the drum.

The bucket 96 has an inclined rear part thus the material can be forced into the augers 98 or directly between the blades 102, if there is no auger. At the front side of the bucket 96 there is a cutter blade taking up the material. The shaft 106 is supported by a support 107 and driven by a hydraulic motor 108.

In some embodiments, instead of the bucket there can be used a long auger or a conveyor with the cutter blade at the same place where there is now the blade of the bucket. The material dug by the movement of the boom of the excavator or the arms of loader is pushed over this cutter blade onto the conveyor belt and transported to the side either into the paddle augers 98 or directly between the blades 102. In other embodiments, the conveyor belt can be replaced with a scraper device in the form of an open box through which blades pass to push material in the box.

Figure 9:
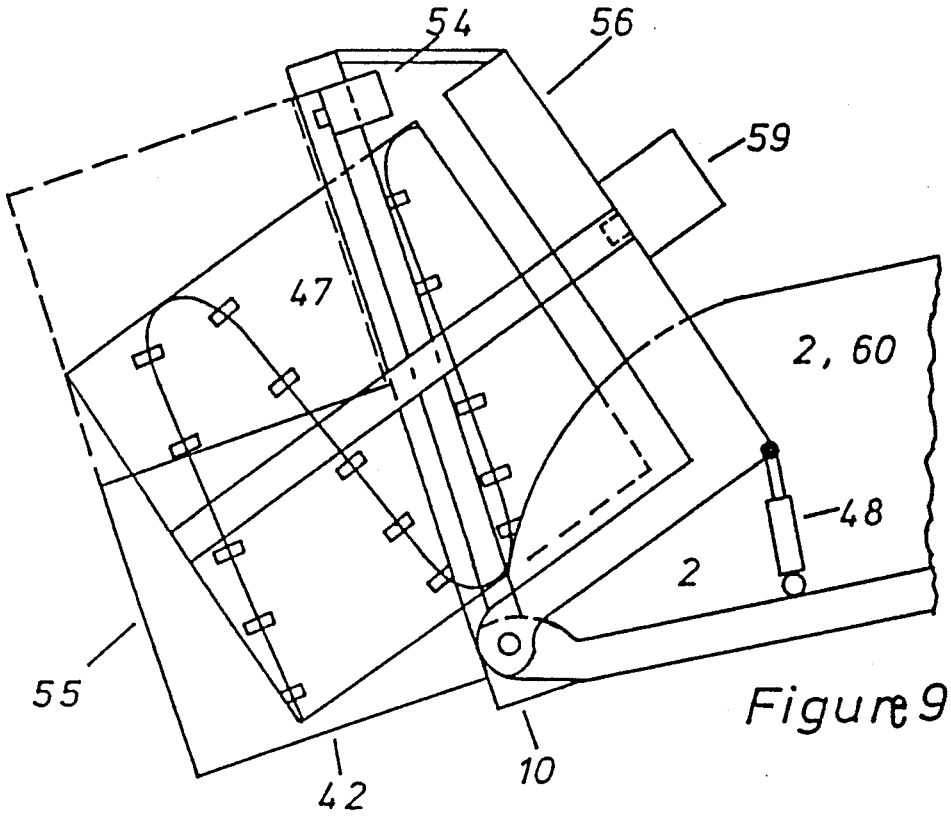
FIG. 9 is a side view of a digging means employing a cutting auger device, which is an alternate to that of FIG. 4.

FIG. 9 is a side view of a cutting auger device 55 as digging means for the accessory. Cutting auger 47 (surrounding rectangle illustrating cutting region) is mounted on a support frame 56, which is tiltably mounted on the combination boom-box conveyor 2, 60. The front part of a rotating means 10 is also mounted on conveyor 2, 60. Auger 47 is driven by an hydraulic motor 59. On the rotating part of this rotating means 10 is mounted a piece of sheet metal shaped in the form of a pipe 42 which is cut in the middle. Pipe 42 can be turned by the hydraulic motor 54 to the upper side (position shown in phantom) when the boom is pressing the auger 47 from above into the bank and which can be turned to the lower side when the auger 47 is pressed from below to the top of the bank, in order to prevent excavated material from falling down.

By hydraulic cylinder 48, frame 56 can be adjusted when the boom is going up and down. The axis of motors 54 and 59 are adjustable by cylinder 48 in order to hold the appropriate angle on the bank, disregarding the changing angle of the boom.

Figure 10:
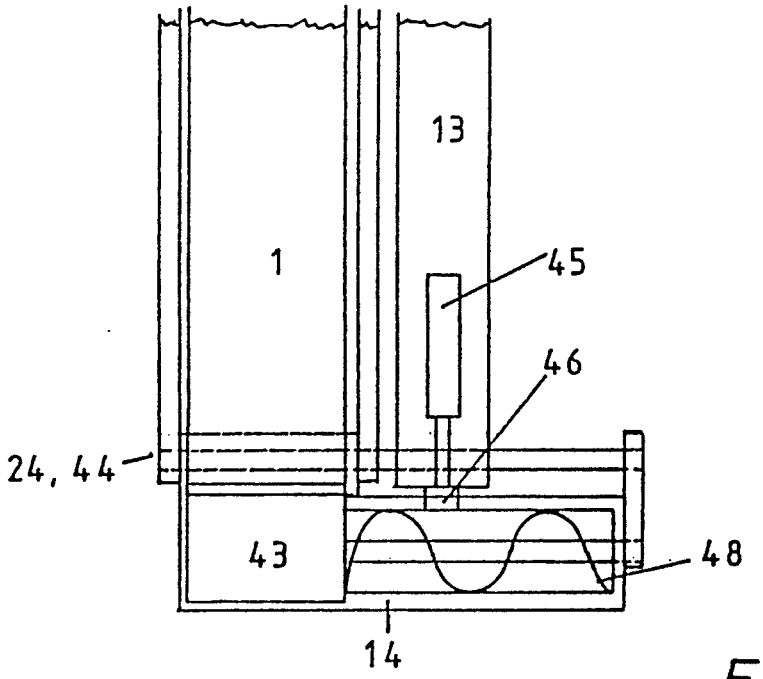
FIG. 10 is a top plan view of a digging means employing a combined bucket and auger on the head of the boom of an excavator, which is an alternate to that of FIG. 4.

FIG. 10 is the top plan view of a bucket 43 with a cutting edge 14 in which an auger 48 is mounted. The bucket 43 is mounted on the boom 13 in the same way as described in FIG. 1, that is, the tilting point of the bucket, the axis of the conveyor belt 1, and axis of the bushing 24 on the boom are coaxial on axis 44. The bucket 43 is connected on a second point 46 with the boom 13 by a cylinder 45. The bucket is positioned about in the middle of the boom. Earth coming from the auger is shifted by the upward boom movement, together with the earth dug by the shovel, onto the conveyor belt.

Figure 11:
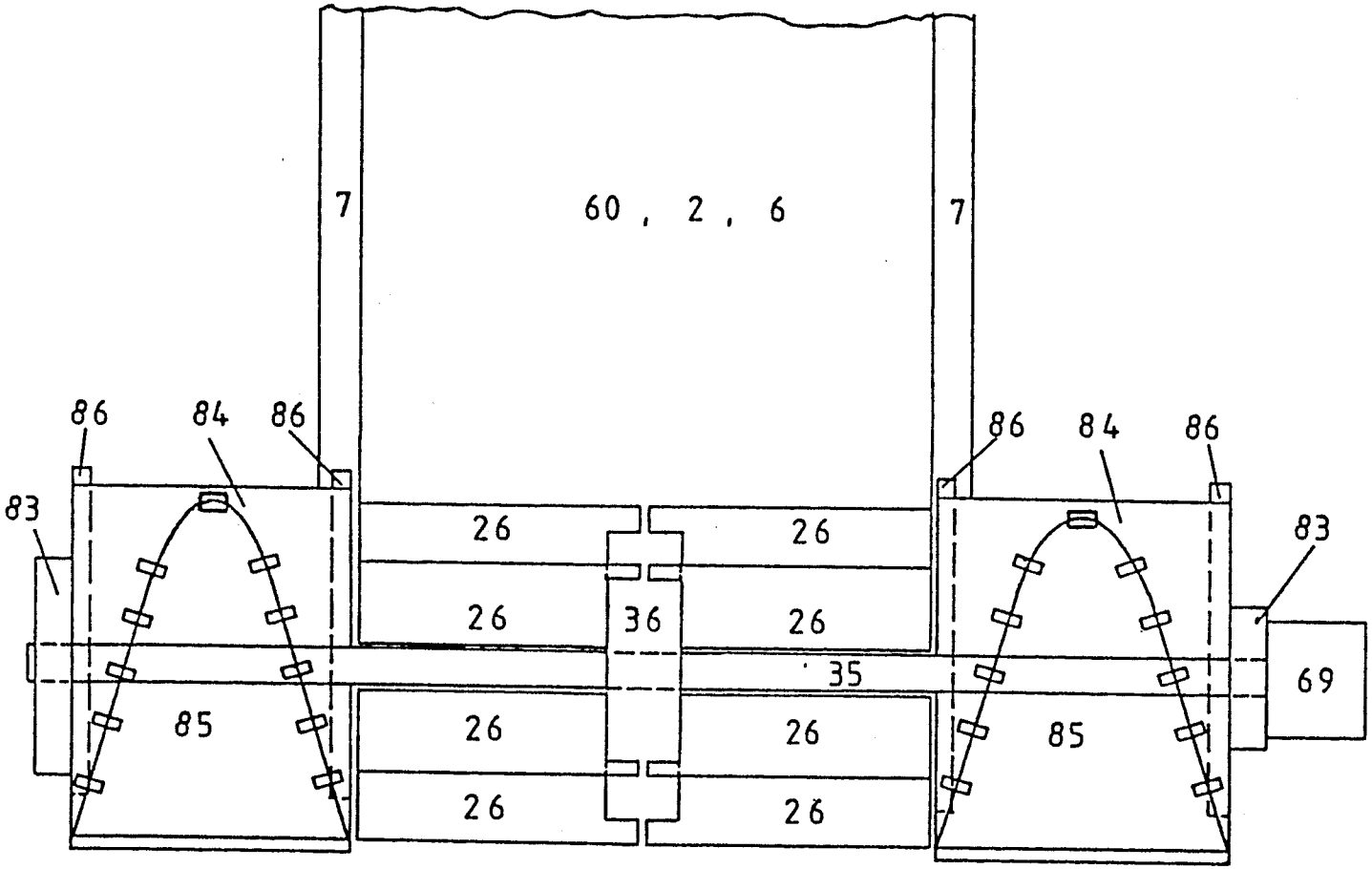
FIG. 11 is a front view of a digging means employing a combined digging wheel with tiltable blades and two augers, which is an alternate to that of FIG. 4.

FIG. 11 is the front view of the combination of two side augers 85 with a digging wheel with tiltable blades 26 guided by a guiding device 36. Augers 85 and digging wheel 26, 36 are mounted on one shaft 35, driven by hydraulic motor 69 and supported by two arms 83. Arms 83 can be the arms of a loader or dozer. Guides 36 are similar to rails 30 and bolts 31 of FIG. 4. Behind the augers 85 are half circle guide rails 86 in which a back cover 84 can be moved. Behind the digging wheel 26, 36 is positioned three-belt, box conveyor 60, 2, 6, 7.

Figure 12:
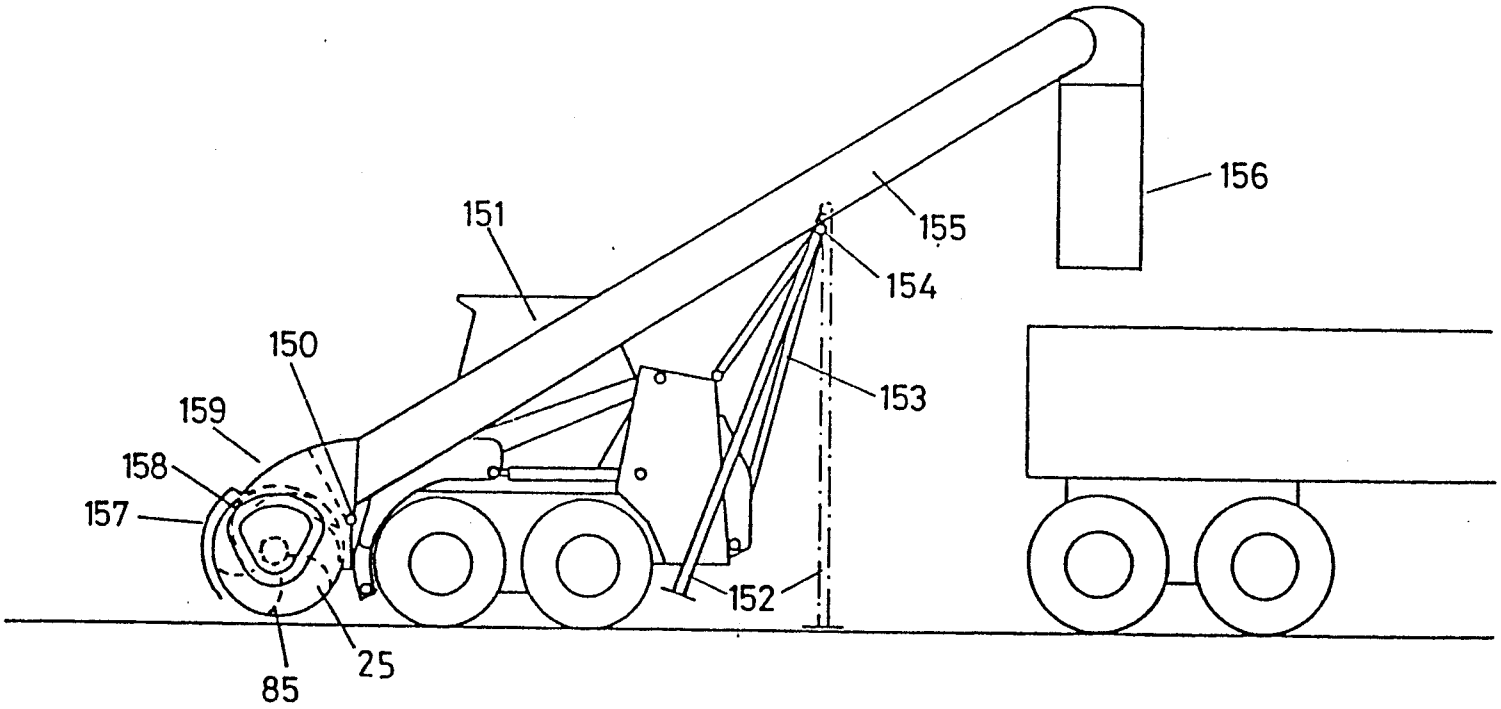
FIG. 12 is a side view of an accessory mounted on a skid steer loader, which is an alternate to that of FIG. 1.

FIG. 12 is a side view of the accessory equipped with an auger/digging wheel combination 25, 85 as digging means mounted on a skid steer loader 151. The guiding rail 158 for the tiltable blades is shaped in such a way that the material is e at the top of the digging wheel 25. A cover plate 157 is mounted in front of the wheel in order to keep the material excavated by the auger 85 in the digging wheel if the loader is working alongside the side of a heap. The excavated material is then pressed by the tilting blades into the chute 159 and from there onto the conveyor 155. Thus the design of the digging wheel 25 makes it possible that the digging wheel/auger combination can be mounted directly in front of the front wheels of a loader because the conveyor can be positioned above the front wheel. That allows this combination to be put even on small skid steer loaders.

The digging wheel/auger combination 25, 85 is connected to the conveyor 155 by a rotating device 150. Device 150 is located on the frame of the digging wheel. The digging wheel and the auger are fixed to the loader arms so that both are liftable. Conveyor 155 will move up with point 150. Point 150 allows the digging wheel to change its angle of elevation.

The conveyor 155 is supported on a support 153, on the top of which is a roller device. Instead of the roller device 154, there can be used a rotating device on top and on the bottom of only one support 153. The loader has on its arms a tilting device for the bucket and a lifting device for the arms. If the present accessory is put on the loader and the tilting and lifting cylinders are used, there is a rotating and lifting movement between the digging wheel 25 and the drum of the conveyor belt 155, and there is further a rotating and lifting movement between the support 153 and the conveyor 155. Further, there is a shifting movement between the conveyor belt 155 and the support 153. The accessory is designed in such a way that it can cope with these movements. The conveyor can be mounted by a support firmly on one arm of the loader, but most loaders are not designed to allow such mounting.

Articulated loaders need a rotating means 150 that can be moved in two directions: rotation up and translation to the side. A second support for the conveyor is modified to shift sidewards. For instance, the second support can have two inserted pipes (not shown) that telescope the outer pipe is pivotally connected with the loader and the inner pipe is pivotally connected to the conveyor. If the loader articulates when, for instance, turning, the conveyor and with it the inner pipe is shifted outwards. On the rear part of the loader is a protection rod (not shown) against which the conveyor is pressed. The inner pipe can be drawn back by a spring.

The chute 156 is used as loading means for trucks. Instead of a chute, there can also be used a loading conveyor mounted firmly, or on a rotating means, or separately behind the loader. The accessory can easily and quickly be connected and disconnected by loosening the bolts on the arms and those of the support 153. After loosening the bolts on the support 152, this support is put on the surface. Thus the conveyor is supported on the surface.

This continual loading accessory can be changed into a piling and stacker attachment by mounting a hopper advantageously with rollers below the hopper in front of the digging wheel/auger device. If stockpiling shall be done in higher piles, then the conveyor can be extended and can be supported on a movable support behind the loader. This movable support can generally be used as a support for a conveyor bridge.

In another embodiment instead of the auger, there can be mounted beside the digging wheel a conveyor with the cutting blade at the side as described in FIG. 8.

Figure 13:
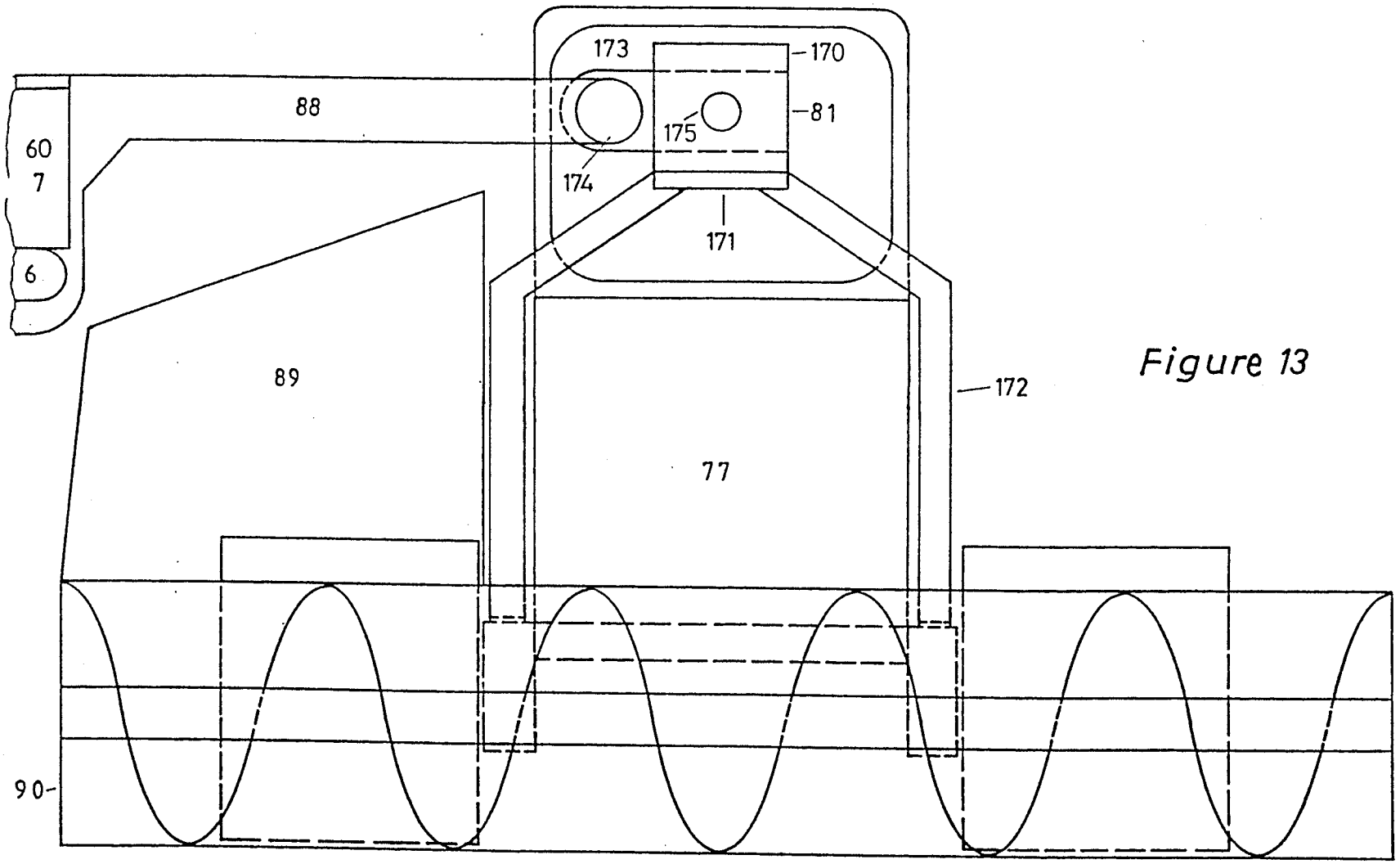
FIG. 13 is a front view of a loading means of an alternate accessory supported on a standard crawler tractor.

FIG. 13 is a front view of a support 172 shaped in such a way that it can be mounted on a standard crawler tractor 77 further comprising a three dimensional rotating device 81 of which a pipe 170 is mounted to rotate on a vertical axis on rotating means 171 fixed on the frame 172. Pipe 173 is mounted in pipe 170 to rotate about a first horizontal axis. In pipe 173 is rotatably mounted, for rotation about a second horizontal axis, another pipe 174 for the tilting. On pipe 174 is mounted a support 88 for the conveyor 60. This support can be as short as shown in the drawing in order to unload the material over a slide 89 into the auger 90 for spreading or into a conveyor rail on the side which the crawler tractor can travel.

The support 88 can be longer, for instance 10 or 20 meters. In this case, the head of conveyor is 10 to 20 meters away from the crawler tractor and the material can be dumped on a high dump as far away to leave the crawler tractor in a safe position. The horizontal movement can be stopped by a sliding bolt 175. In this case, the conveyor can be supported in such a way, that the end of it is on the other side of the crawler tractor. The support 172 can be extended ahead of the cabin in order to be able to move the tractor at any direction below the conveyor. In another embodiment, there can be two or more conveyor bridges with supports between the excavator and the place of unloading (dump), carried by crawler or wheel tractors as carriers.

Figure 14:
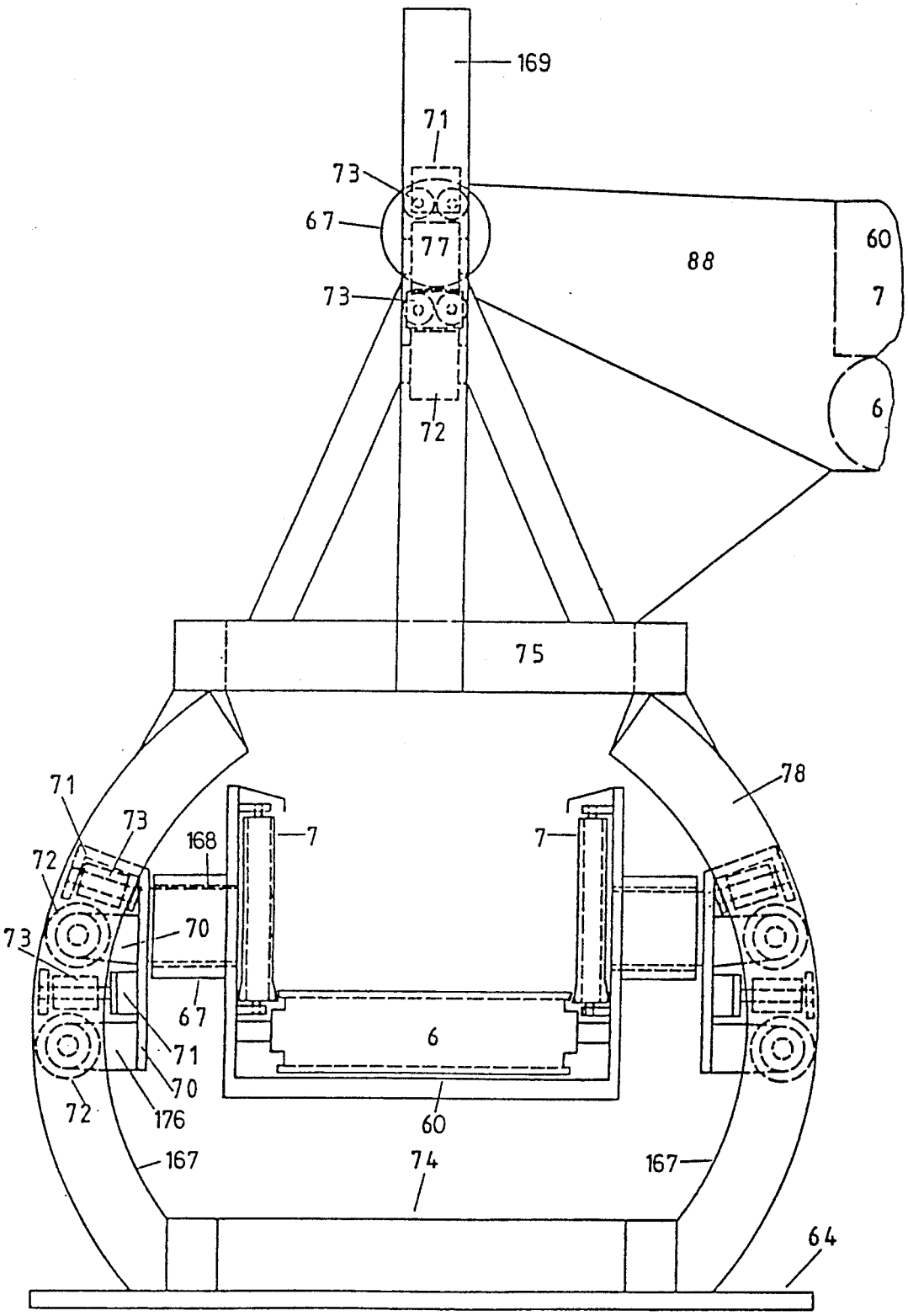
FIG. 14 is a front view of a support as part of the loading means.

FIG. 14 is the front view of a support 78 of the loading means (for example the loading means of FIG. 2) with a double, three dimensional rotating means for a carrier, like a crawler tractor or a stationary support. Base plate 64 rotatably supports azimuthal rotating means 74, on which are fixed curved, rails 167 having a U-shaped cross-section accommodating a pair of circumferential rollers 72 and two pairs of thrust rollers 73. These rollers 72 and 73 connect by rods 80, 71, 176 to a pipe 168. This pipe is rotatably mounted in a further pipe 67 which connects to departing conveyor 6, 7, 60.

On top of the curved rails 167 is mounted the azimuthal rotating means 75 for the arriving conveyor 6, 7, 88 so that both azimuthal rotating means 74, 75 are coaxial. On the upper azimuthal rotating means 75 are mounted two curved rails 169 for rollers 72, 73 and the two pairs of nested pipes; that is, one pipe 67 rotating in pipe 168. Rails 169 are shaped the same as rails 78. The identically numbered rollers in this Figure are shaped and supported identically.

On outside pipe 67 is mounted support 88 which keeps the arriving box-type conveyor 6, 7, 60 at such a distance that the material can be unloaded through the upper rotating means 75 to the departing conveyor. In addition embodiment, the departing conveyor can be connected by a cylinder with the lower rotating means 74, which can be controlled by an hydraulic motor. In this case, the departing conveyor can be used as an unloading means.

In another embodiment, the upper rails 169 can be deleted. On the upper horizontal rotating means 75 can then be mounted directly the arriving conveyor. It is also possible, to mount the departing conveyor directly on the lower horizontal rotating means 74 or on the base plate 64.

Figure 15:
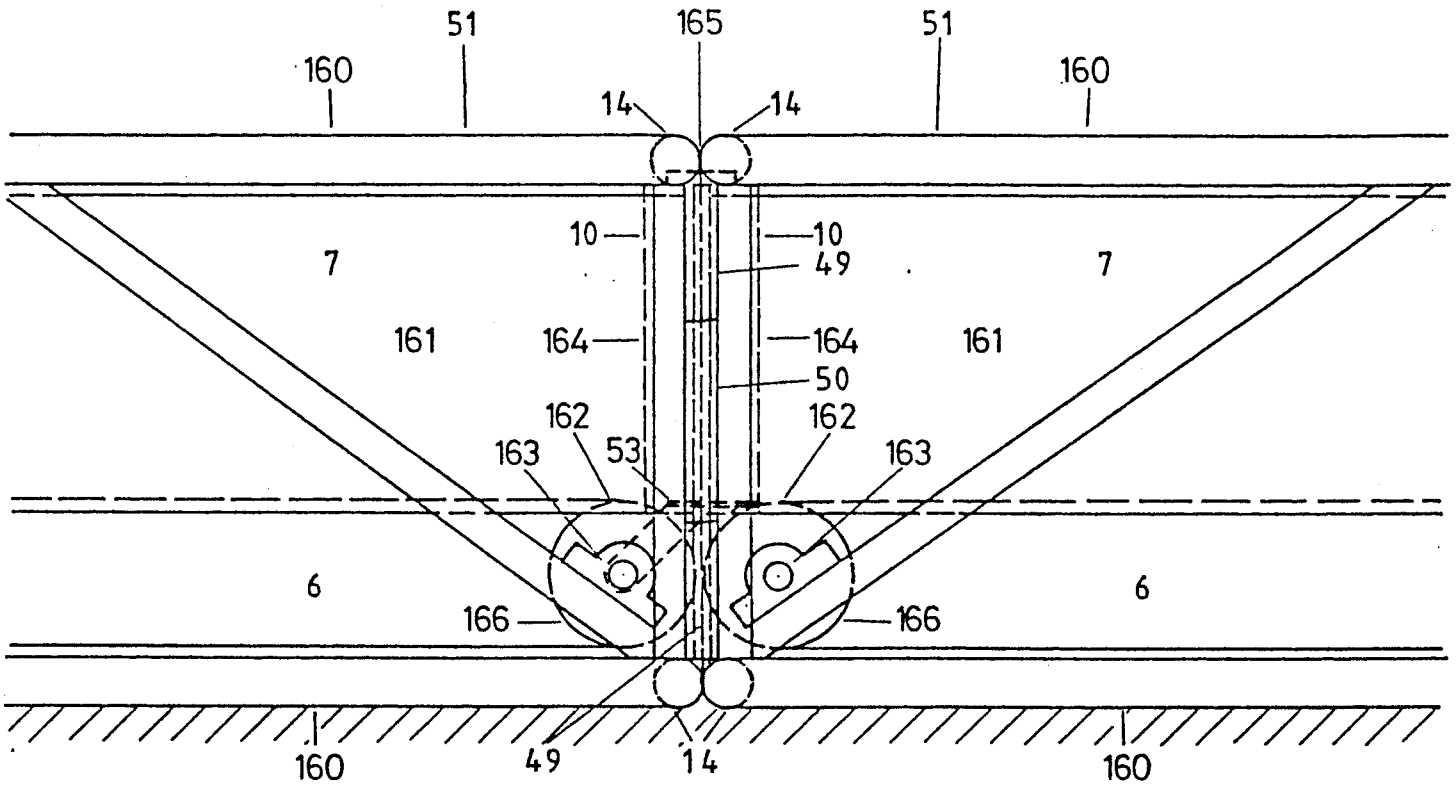
FIG. 15 is a side view of a loading means comprising conveyor rails.

FIG. 15 is a side view of two, three-belt box conveyor rails, as part of the loading means and shaped so that they can be coupled together on the same level. Each of these conveyor rails comprise a frame with longitudinal rods 160, horizontal transverse rods 14, vertical rods 10, two vertical conveyors 7, and one horizontal conveyor 6. Also shown are the upper conveyor belt of the horizontal conveyor 6, the lower conveyor belts of the vertical conveyors 161, the drums 166 of the horizontal conveyor 6 and the support 163 of these belts, as well as the drums 164 of the vertical conveyors 7. The two conveyor rails are connected by a bushing-bolt connection on either side. The upper and lower bushing 49 is welded on the right one of the rods 10. The bushing in the middle 50 is welded on the left one of the rods 10. By the bolt 165 are connected both rods 14. If the rails shall turn right or left, the bolt on the outside is removed and there is put between the bushings welded on the two rails a spacer with bushings on each side corresponding to the bushings welded on the rails. By putting a bolt on each side in the bushings, the rails are connected. The spacer can be adjustable.

If the rails are put together with an inclination, there can be used a similar spacer which has two rods/struts with bushings which are connected rotatably at the one end. This rotating point is on the top of the connection line if the inclination is upwards (convex, viewed from above) or below if it is downwards (concave, viewed from above). On the outside of the rods/struts is an adjusting means, for instance a jack screw. The connection between the rails and the spacers is done by bolts placed in the bushings.

A bridging means 53 with a plate is positioned in the space between the belts running around the drums 166. The transported material coming from the right side slides over the plate of the bridging means 53 onto the left belt. The bridging means 53 is mounted on the departing conveyor and is pressed by a spring on the arriving conveyor belt, thus functioning as a scraper. Similar bridging means are used on the vertical conveyors 7 of three-belt box conveyors and similar bridging means are also used if the rails are put in curves or in an inclination. In the latter case, the plates of the bridging means 53 are adjustable, for instance with two plates shiftable in longitudinal direction and around a rotating point.

Conveyor rails are especially advantageous if they are equipped with a three-belt box conveyor because these rails are very compact and have relatively great capacity. The vertical conveyors are used as structural means. These conveyor belts are easy to load and unload from a lorry, to transport, and to lay. If they have skis, they can be drawn by crawler tractors. Because the bottom conveyor belt has no trough there is no detroughing on the transition places of the conveyor rail ends. Thus there is no disturbance of the material flow. As part of the loading means of the accessory for earth moving equipment, these conveyor rails are adjusted to the high digging capacity of the digging means mounted on the excavator. Digging means, transport means and loading means are complementary and form the unit of the continual digging-transport-loading accessory for earth moving equipment.

In a very effective embodiment, the loading means for unloading the dug material on a dump comprises a three-belt, box type, telescopic conveyor bridge 60, 7, 6 mounted on the one end on a rotating means (such as means 11, 12 of FIG. 1) on the upper carriage of an excavator or of a loader; the other end having a support with a rotating means (such as means 81 of FIG. 13) for mounting on a standard wheel or crawler tractor. The loading means further comprises a number of three-belt, box conveyor rails (FIG. 15) coupled behind each other to form a conveyor rail road in which the material is transported from the conveyor bridge to an unloading place; or further comprising a support with a rotatable means (such as means 78 of FIG. 14, or means 81 of FIG. 13, or means 11, 12 of FIG. 1) mounted on a carrier which can be stationary, movable or self-propelled like a tractor. This support is connected on the one hand with a conveyor rail and on the other hand with the end of a telescopic, three-belt, box conveyor bridge, which has a second support, and which is mounted on a tractor which moves the end of the conveyor bridge to those places where the material shall be dumped.

This embodiment of the invention will work about three to four times as effectively as can be done with standard excavators and dump trucks using the same amount of capital investment. In addition, the contractor has the advantage of using standard, available earth moving equipment. This described embodiment can also be used on stockyards; for instance, for loading ships from stockpiles. In comparison with a bucket wheel excavator conveyor system used in pits, the inventive system is a much more flexible one.

We claim:

1. A continual digging, transporting, and loading accessory for handling material, said accessory being adapted for exchangeable attachment on material moving equipment, comprising:

digging means outwardly mounted on said material moving equipment for digging said material;

transport means having an inward unloading end mounted on said material moving equipment and an outward onloading end mounted adjacent to said digging means for receiving and transporting the material dug by the digging means, said transport means having a carrying means for moving between said onloading end and said unloading end to carry said material; and loading means mounted on said material moving equipment and having a loading end positioned to receive and transport away from said material moving equipment the material discharged from the unloading end of the transport means, at least one of said transport means and said loading means comprising:

a conveyor having a pair of components telescopically interconnected with respect to each other.

2. An accessory according to claim 1 wherein the material moving equipment comprises an excavator having a boom, an undercarriage and an upper carriage, said loading end of said loading means being rotatably mounted on the upper carriage of the excavator, said digging means being mounted on the front of the boom, the onloading end of said transport means being mounted proximate the digging means to receive the material dug by the digging means, the unloading end of said transport means being mounted proximate to the upper carriage of the excavator.

3. An accessory according to claim 2 further comprising:

load support means mounted on said undercarriage for supporting said loading means.

4. An accessory according to claim 3 further comprising a means operable to allow the loading means to move longitudinally and laterally on the load support means.

5. An accessory according to claim 3 wherein the load support means has a lower skid.

6. An accessory according to claim 5 further comprising a means operable to allow the loading means to move longitudinally and laterally on the load support means.

7. An accessory according to claim 1 wherein the material moving equipment comprises a machine having a rotating means for rotatably supporting a boom, said digging means being mounted on the front of the boom, the onloading end of said transport means being mounted proximate the digging means to receive the material dug by the digging means, the unloading end of said transport means being mounted at said machine above the rotating means.

8. An accessory according to claim 1 wherein said material moving equipment includes an excavator having an upper carriage, said accessory comprising:

a boom mounted on the upper carriage and connected with said transport means, said boom having an outer end and an inner end, said inner end being supported on the upper carriage of said excavator, said digging means being adapted for mounting on the outer end of said boom.

9. An accessory according to claim 1 further comprising:

swivel means for supporting the loading means upon said material moving equipment with one to three degrees of angular freedom.

10. An accessory according to claim 1 comprising a rotating joint means between the outer onloading end of the transport means and the digging means to allow tilting of the digging means in relation to the transport means.

11. An accessory according to claim 10 wherein said digging means is mounted to tilt about a tilting axis that is coaxial with the turning axis of the transport means.

12. An accessory according to claim 1, wherein said conveyor comprises three conveyor devices, one in a floor position, the other two adjacent thereto set with an orientation between upright to inclined, so that the inside of said three conveyor devices form a box which is closed on the bottom and on two sides and open on the top and at two ends.

13. An accessory according to claim 1 wherein said material moving equipment includes a backhoe loader having a rotating means for providing rotative support, said accessory comprising:

a boom mounted on said rotating means and connected with said transport means, said boom having an outer end and an inner end, said inner end being supported on the rotating means of said backhoe loader, said digging means being adapted for mounting on the outer end of said boom.

14. An accessory according to any one of the claims 1, 2, 7, 8 or 13, wherein the loading means comprises:

at least one loading conveyor; and at least one mobile carrier having means for supporting said loading means.

15. An accessory according to claim 14, wherein the mobile carrier comprises a tractor.

16. An accessory according to claim 1, 2, 8 or 13 wherein the loading means comprises:

a plurality of conveyors connected end-to-end; and at least one revolving means adapted for mounting on a carrier, said revolving means being operable to rotatably support at least one of said conveyors.

17. An accessory according to claim 1, 2, 8 or 13 wherein the loading means comprises:

a conveyor railway including at least two conveyor rails connected end-to-end at the same height; and bridging means mounted between an arriving one and a departing one of said conveyors, said bridging means being shaped to allow material to slide across said bridging means from the arriving one to the departing one of said conveyors.

18. An accessory according to claim 17 wherein the bridging means comprises a scraper for cleaning one of said conveyors.

19. An accessory according to claim 17, wherein said conveyor comprises three conveyor devices, one in a floor position, the other two adjacent thereto set with an orientation between upright to inclined, so that the inside of said three conveyor devices form a box which is closed on the bottom and on two sides and open on the top and at two ends.

20. An accessory according to claim 19 wherein the loading means comprises:

a take-up conveyor connected with and downstream of the conveyor railway; and a bridging means mounted between the conveyor railway and the take-up conveyor, said bridge means being shaped to allow the material to slide across said bridging means from the conveyor railway onto the take-up conveyor.

21. An accessory according to claim 20 further comprising:

an unloading means connected with and downstream of said take-up conveyor for unloading said take-up conveyor and further transporting the material.

22. An accessory according to claim 20 further comprising:

a secondary conveyor bridge having an onloading terminus connected with and downstream of said take-up conveyor for moving therefrom said material.

23. An accessory according to claim 1, 2, 8 or 13 wherein said loading means comprises:

a conveyor providing said loading end;

swivel means for supporting the conveyor at the loading end; and a motor for aximuthally rotating said conveyor.

24. An accessory according to any one of claims 1, 2, 7, 8, 10 or 13 wherein the digging means is a bucket.

25. An accessory according to any one of claims 1, 2, 7, 8 or 13 further comprising:

a hopper communicating with said digging means.

26. An accessory according to any one of claims 1, 2, 8 or 13 wherein the loading means comprises:

a primary conveyor bridge having an onloading end mounted on the material moving equipment, said primary conveyor bridge having an offloading end adapted to be rotatably connected to and supported by a downstream tractor, said primary conveyor bridge including at least one conveyor; and a conveyor railway including at least two conveyor rails for receiving the material from the offloading end of said primary conveyor bridge.

27. An accessory according to claim 26 wherein the loading means comprises:

a secondary conveyor bridge having an onloading terminus connected with the conveyor railway, said secondary conveyor bridge having a support for supporting said onloading terminus, said secondary conveyor bridge having an unloading terminus adapted to be supported by another carrier.

28. An accessory according to claim 27 wherein at least one of a) said primary conveyor bridge, b) said secondary conveyor bridge, and c) the conveyor railway, comprise:

a three-sided box conveyor, comprising three conveyor devices, one in a floor position, the other two adjacent thereto set with an orientation between upright to inclined, so that the inside of said three conveyor devices form a box which is closed on the bottom and on two sides and open on the top and at two ends.

29. An accessory according to any one of claims 1, 2, 8 or 13, the loading means comprising:

a primary conveyor bridge having an onloading end mounted on the material moving equipment, said primary conveyor bridge having an offloading end adapted to be connected to and supported by a downstream carrier, said primary conveyor bridge including at least one conveyor; and a conveyor railway including at least two conveyor rails for receiving the material from the offloading end of said primary conveyor bridge.

30. An accessory according to claim 29 wherein the loading means comprises:

a take-up conveyor connected with and downstream of the conveyor railway; and a bridging means mounted between the conveyor railway and the take-up conveyor, said bridge means being shaped to allow the material to slide across said bridging means from the conveyor railway onto the take-up conveyor.

31. An accessory according to claim 30 further comprising:

an unloading means connected with and downstream of said take-up conveyor for unloading said take-up conveyor and further transporting the material.

32. An accessory according to claim 30 further comprising:

a secondary conveyor bridge having an onloading terminus connected with and downstream of said take-up conveyor for moving therefrom said material.

33. A continual digging, transporting, and loading accessory for handling material, said accessory being adapted for exchangeable attachment on material moving equipment, comprising:

digging means outwardly mounted on said material moving equipment for digging said material;

transport means having an inward unloading end mounted on said material moving equipment and an outward onloading end mounted adjacent to said digging means for receiving and transporting the material dug by the digging means, said transport means having a carrying means for moving between said onloading end and said unloading end to carry said material; and loading means mounted on said material moving equipment and having a loading end positioned to receive and transport away from said material moving equipment the material discharged from the unloading end of the transport means, the loading means comprising:

(a) a primary conveyor bridge having an onloading end mounted on the material moving equipment, said primary conveyor bridge having an offloading end adapted to be rotatably connected to and supported by a downstream tractor, said primary conveyor bridge including at least one conveyor; and (b) a conveyor railway including at least two conveyor rails for receiving the material from the offloading end of said primary conveyor bridge; and a secondary conveyor bridge having an onloading terminus connected with the conveyor railway, said secondary conveyor bridge having a support for supporting said onloading terminus, said secondary conveyor bridge having an unloading terminus adapted to be supported by another carrier.

34. A continual digging, transporting, and loading accessory for handling material, said accessory being adapted for exchangeable attachment on material moving equipment, comprising:

digging means outwardly mounted on said material moving equipment for digging said material;

transport means having an inward unloading end mounted on said material moving equipment and an outward onloading end mounted adjacent to said digging means for receiving and transporting the material dug by the digging means, said transport means having a carrying means for moving between said onloading end and said unloading end to carry said material; and loading means mounted on said material moving equipment and having a loading end positioned to receive and transport away from said material moving equipment the material discharged from the unloading end of the transport means, the loading means comprising:

(a) a conveyor railway including at least two conveyor rails connected end-to-end at the same height; and (b) bridging means mounted between an arriving one and a departing one of said conveyors, said bridging means being shaped to allow material to slide across said bridging means from the arriving one to the departing one of said conveyors.

35. A continual digging, transporting, and loading accessory for handling material, said accessory being adapted for exchangeable attachment on material moving equipment, comprising:

digging means outwardly mounted on said material moving equipment for digging said material;

transport means having an inward unloading end mounted on said material moving equipment and an outward onloading end mounted adjacent to said digging means for receiving and transporting the material dug by the digging means, said transport means having a carrying means for moving between said onloading end and said unloading end to carry said material; and loading means mounted on said material moving equipment and having a loading end positioned to receive and transport away from said material moving equipment the material discharged from the unloading end of the transport means, the loading means comprising:

(a) a primary conveyor bridge having an onloading end mounted on the material moving equipment, said primary conveyor bridge having an offloading end adapted to be connected to and supported by a downstream carrier, said primary conveyor bridge including at least one conveyor; and (b) a conveyor railway including at least two conveyor rails for receiving the material from the offloading end of said primary conveyor bridge;

(c) a take-up conveyor connected with and downstream of the conveyor railway; and (d) a bridging means mounted between the conveyor railway and the take-up conveyor, said bridge means being shaped to allow the material to slide across said bridging means from the conveyor railway onto the take-up conveyor, said accessory further comprising:

a secondary conveyor bridge having an onloading terminus connected with and downstream of said take-up conveyor for moving therefrom said material.

36. A continual digging, transporting, and loading accessory for handling material, said accessory being adapted for exchangeable attachment on material moving equipment, comprising:

digging means outwardly mounted on said material moving equipment for digging said material;

transport means having an inward unloading end mounted on said material moving equipment and an outward onloading end mounted adjacent to said digging means for receiving and transporting the material dug by the digging means, said transport means having a carrying means for moving between said onloading end and said unloading end to carry said material; and loading means mounted on said material moving equipment and having a loading end positioned to receive and transport away from said material moving equipment the material discharged from the unloading end of the transport means, the loading means comprising:

(a) a conveyor railway including at least two conveyor rails connected end-to-end at the same height; and (b) bridging means mounted between an arriving one and a departing one of said conveyor rails, said bridging means being shaped to allow material to slide across said bridging means from the arriving one to the departing one of said conveyor rails, each of said conveyor rails comprising:

three conveyor devices, one in a floor position, the other two adjacent thereto set with an orientation between upright to inclined, so that the inside of said three conveyor devices form a box which is closed on the bottom and on two sides and open on the top and at two ends.

* * * * *